United States Patent [19]

Hollingsworth

[11] Patent Number: 4,824,171

[45] Date of Patent: Apr. 25, 1989

[54] COLLAPSIBLE BEACH CHAIR

[76] Inventor: W. Dale Hollingsworth, 742 Ridgefield Rd., Wilton, Conn. 06897

[21] Appl. No.: 169,436

[22] Filed: Mar. 17, 1988

[51] Int. Cl.[4] ..... A47C 1/14; A47C 15/00

[52] U.S. Cl. ..... 297/351; 297/380

[58] Field of Search ..... 297/351, 350, 380, 382

[56] References Cited

U.S. PATENT DOCUMENTS

| | | | |
|---|---|---|---|
| 1,625,106 | 4/1927 | Sullivan | 297/351 |
| 1,955,040 | 4/1934 | Wittcoff | 297/382 |
| 2,001,252 | 5/1935 | Johnson | 297/350 |
| 2,239,669 | 4/1941 | Blake | 297/380 X |
| 2,457,978 | 1/1949 | Curran | 297/350 |
| 3,709,557 | 1/1973 | Light | 297/350 |
| 4,181,356 | 1/1980 | Fleischer | 297/350 |

FOREIGN PATENT DOCUMENTS

| | | | |
|---|---|---|---|
| 1002982 | 11/1951 | France | 297/350 |
| 459000 | 12/1936 | United Kingdom | 297/351 |
| 926425 | 5/1963 | United Kingdom | 297/380 |

*Primary Examiner*—Francis K. Zugel

*Attorney, Agent, or Firm*—Epstein & Edell

[57] ABSTRACT

A collapsible beach chair which is formed from a covering, such as canvas, which is folded and joined together to define a pair of seat compartments and a pair of back compartments with the compartments being joined together by a transverse hinge portion of the covering. The seat compartments are joined together by a longitudinal hinge portion of the covering separate and apart from a longitudinal hinge portion of the covering joining together the back compartments. Each compartment has therein a stiffening element which includes a rigid backing having a padded surface. The hinge portions of the covering are so arranged that the seat may be folded with all four compartments being disposed in side-by-side relationship and with the back forming compartments disposed outermost. The back forming compartments are joined together by releasable strap means and carry handles to facilitate the carrying thereof. If desired, suitable strap means may be provided for tying together the handles and there may be a shoulder carrying strap. There are further strap means between the seat compartments and the back compartments for maintaining the back compartments at selected upstanding positions relative to the seat portion.

8 Claims, 2 Drawing Sheets

COLLAPSIBLE BEACH CHAIR

BACKGROUND OF THE INVENTION

1. Technical Field

The present invention relates to collapsible beach chairs and, more particularly, to beach chairs that are sufficiently rigid to provide support when in use and foldable to a conveniently transportable configuration.

2. Discussion of the Prior Art

There are numerous factors to be considered in the design of collapsible beach chairs. First and foremost, the chair must provide sufficient support to be comfortable for the user. In this regard, in many collapsible beach chairs only fabric (such as canvas, or the like) provides support for the human body; for example, the fabric itself may be adapted to attach to posts that can be bored into the sand to support the fabric without supporting the body of the user. The collapsible fabric chairs can be rolled or folded into very small configurations for convenient transport, but the lack of comfort renders these chairs undesirable for many consumers.

Some collapsible beach chairs have rigid mutually pivotable metal frames spanned by plastic or fabric material strips serving as the body support for the user. The rigid metal frames limit the extent to which the chair can be folded for convenient transportability; in particular, the minimum possible size of the folded configuration corresponds to a two level stack comprising the entire chair back at one level and the entire chair seat at the other level. Moreover, it is common experience to have the pivot joints of these chairs clog with sand and become non-functional.

A collapsible chair is disclosed in U.S. Pat. No. 2,001,252 (Johnson) and 2,457,978 (Curran) in which the seat and back are formed from multiple parallel slats joined at their ends. The slats provide sufficient rigidity to effect use comfort, although the unit is somewhat bulky for transport purposes when it is rolled up in its collapsed state. More importantly, sand easily migrates through the slats and into contact with the body of the user, thereby causing irritation and discomfort.

Additional considerations that must be borne in mind for collapsible beach chairs are the ease with which the chair can be collapsed and erected, the ease with which the chair may be carried by a user during transport, and the thermal conductivity of the cover material which must be very low in order to avoid burning the user. In addition, the cover material must be relatively resistant to agglomeration of sand.

OBJECTS AND SUMMARY OF THE INVENTION

It is an object of the present invention to provide a collapsible beach chair having sufficient rigidity to be comfortable for the user while being collapsible into a configuration that is easily transported.

Another object of the present invention is to provide a collapsible beach chair having sufficient rigidity to provide comfort without requiring mechanical joints that can be damaged by sand, and wherein collapsed chair can be carried in plural alternative orientations during transport.

It is a further object of the present invention to provide a compactly collapsible beach chair that is comfortable to use, easy to erect and collapse, and impervious to passage of sand through the chair into contact with the body of the user.

In accordance with the present invention a collapsible beach chair includes a back portion and a seat portion, each having two side-by-side panels. The panels are formed by respective rigid padded inserts disposed in respective compartments formed in a canvas cover enclosing the entire unit. The compartments are defined by stitched seams in the canvas cover and are spaced to permit the chair to be easily folded into a stack comprising the four panels. The collapsed stack has length and width dimensions corresponding to the length and width of an individual panel, and a thickness dimension corresponding to the combined thicknesses of the four panels. A handle and a shoulder strap are provided to permit the stack to be alternatively carried by hand or over the user's shoulder in accordance with whether or not the user has a free hand.

The back and seat portions can be oriented at substantially any mutual angle by means of adjustable straps. A single back strap, having buckles at each end, extends transversely through the back portion interior and is secured in place by stitching so as to extend out from the back portion edge seams. A single seat strap extends transversely through the seat portion interior and is similarly stitched so as to extend out from the seat portion edge seams. The buckled ends of the back strap are selectively secured along respective selected portions of the seat strap length to select the desired angular orientation between the seat and back portions.

When the seat portion is placed on a sandy surface, the canvas cover material prevents sand from passing through the seat or back portion into contact with the user. The cover is preferably formed from only two pieces of canvas material that are easily stitched together as part of a simple assembly procedure.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures, are utilized to designate like components, and wherein.

DESCRIPTION OF THE PREFERRED EMBODIMENTS

Figure 1:
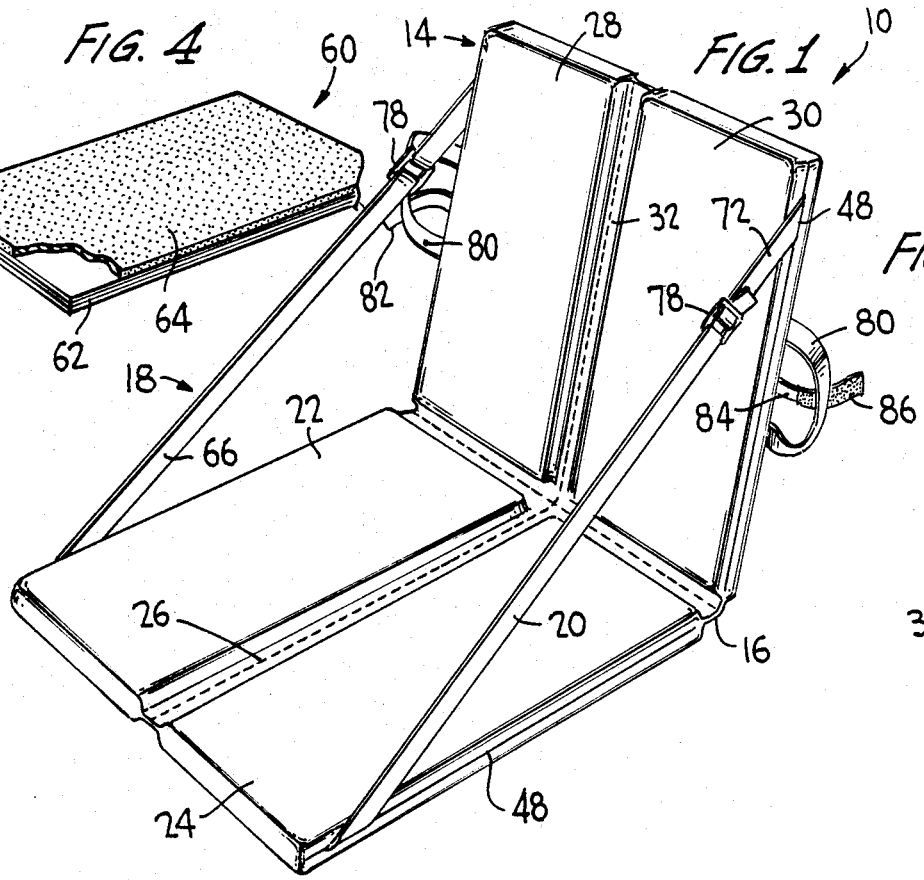
FIG. 1 is a view in perspective of the beach chair of the present erected for use.

Referring now to the drawings in detail, it will be seen that the collapsible beach chair is generally identified by the numeral 10 and is illustrated in its operative position in FIG. 1. The chair 10 includes a seat portion 12 and a back portion 14 which are connected together by a transverse hinge portion 16. It is intended that the seat portion 12 rest upon the sand or ground while the back portion 14 is supported in a selected upstanding position by way of adjustable and releasable support strap means 18 and 20 which will be described in detail hereinafter.

The seat portion 12 is generally divided into a pair of compartments 22, 24 by a longitudinal seat hinge portion 26. In a like manner, the back portion 14 is divided into a pair of compartments 28, 30 by a longitudinal back hinge portion 32.

Figure 3:
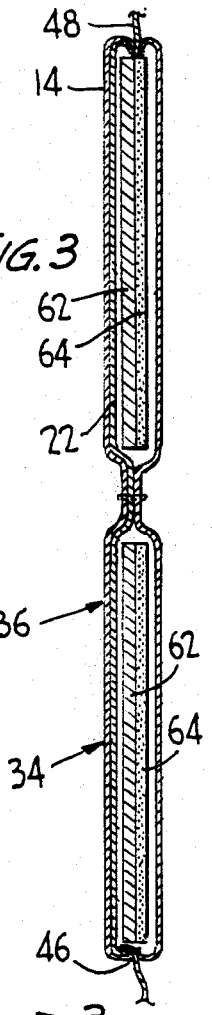
FIG. 3 is a view in section taken along lines 3—3 of FIG. 2.
Figure 2:
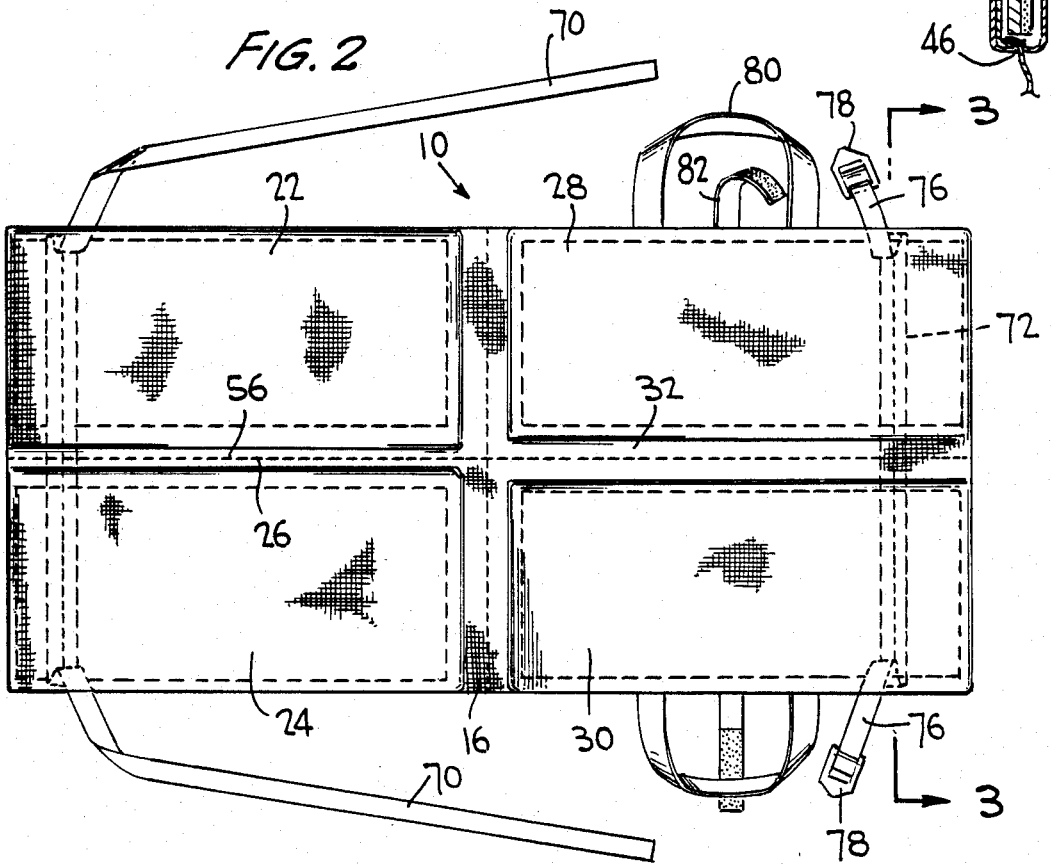
FIG. 2 is a top view in plan of the beach chair of FIG. 1 laid out flat.
Figure 6:
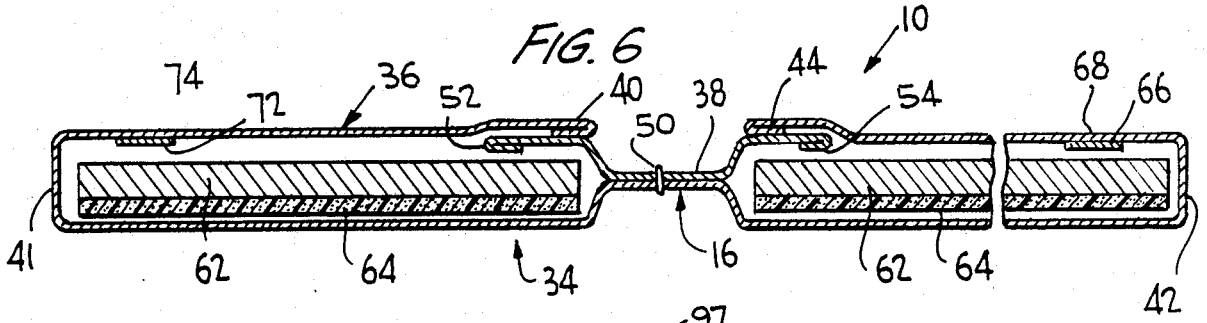
FIG. 6 is a view in section taken along lines 6—6 of FIG. 5.

Referring now to FIGS. 3 and 6 in particular, it will be seen that the chair 10 is primarily defined by a cover assembly 34 which is formed of canvas and like material. Further, the cover assembly 34 is formed of an elongated piece of material which will be defined here as a cover 36, and a transversely extending cover strip 38 which extends transversely of the chair 10 between opposite ends of the cover 36. As is best shown in FIG. 6, the cover 36 starts with a hemmed edge 40 adjacent the transverse hinge portion 16 at the rear of the chair 10 and extends to the bottom or end of the chair in a web portion 41. The cover 36 then extends along the front of the chair 10 for the full height of the chair to the top or opposite end of the chair where it forms a web portion 42. The cover 36 then extends down the back of the seat and terminates in a further hemmed edge 44 adjacent hinge 16 in parallel spaced relation to hemmed edge 40.

As is best shown in FIG. 3, the edges of the cover 36 are joined together in seams 46, 48. The ends of the cover strip 38 are incorporated in the seams 46, 48 with the cover strip 38 being otherwise secured to a central front portion of the cover 36 along a transverse seam 50. The opposite edges of the cover strip 38 are provided with sewn hems 52, 54. In addition, there is a line of stitching 56 which extends longitudinally of the seat in the center of the seat for the full height or length of the seat. The front and rear parts of cover 36 may additionally be secured together such as by adhesive bonding to provide for a narrow stiff hinge section to more particularly define the longitudinal seat hinge portion 26 and a wider stiff hinge section to more particularly define the longitudinal back hinge portion 32.

Figure 4:
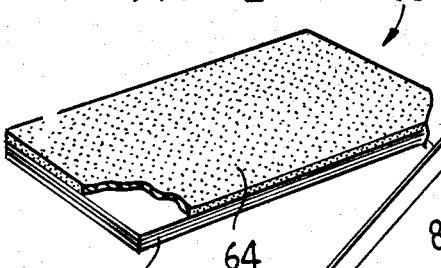
FIG. 4 is a partially broken view in section of a padded rigid insert employed in the beach chair of FIG. 1.

Returning to FIG. 6, it will be seen that at the rear of the seat 10, those edges of the compartments 22, 24, 28 and 30 which oppose and are adjacent the transverse hinge portion 16 are open between the hems of the cover 36 and the edges of the cover strip 38. This permits each of the compartments 22, 24, 28 and 30 to have removably inserted therein a stiffening element which is best illustrated in FIG. 4 and is identified by the reference numeral 60. Each stiffening element 60 includes a rigid backing 62, which may be formed of wood, plastic, or other suitable material. The rigid backing 62 has on a front face thereon a suitable padding 64.

Although it is preferred that the stiffening element 60 be removable, it is also feasible that after the stiffening elements 60 have been placed in their respective compartments, the end portions of the cover 36 be sewn or otherwise bonded to edge portions of the cover strip 38.

Figure 5:
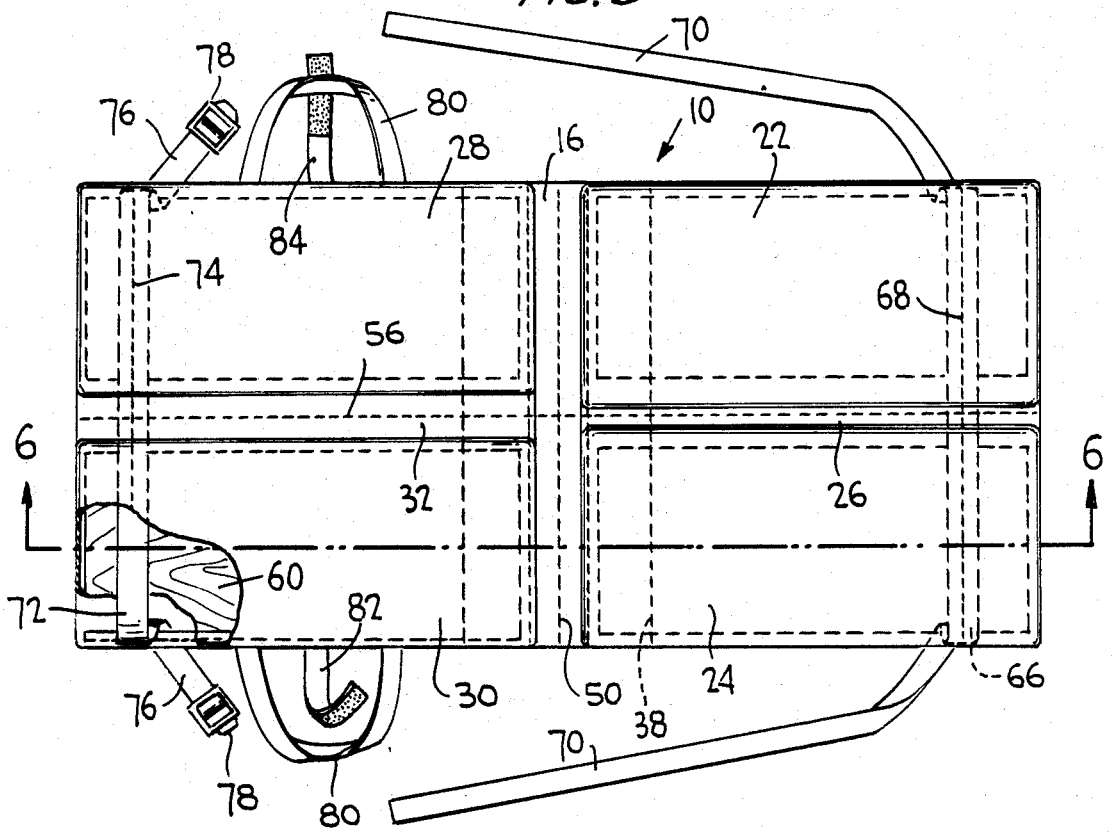
FIG. 5 is a bottom view in plan of the beach chair of FIG. 1 laid out flat.

As broadly described above, the back portion 14 is connected to the seat portion 12 by support strap means 18, 20. These are formed by a first strap 66 which extends through the compartments 22, 24 and out through the edge seams 46, 48. The strap 66 has the central portion thereof anchored by being sewn at the back of the seat to the inner surface of the cover 36 by stitching 68, as is best shown in FIGS. 5 and 6. The strap 66 has elongated free end portions 70.

The support strap means 18, 20 also include a second strap 72 which extends through the compartments 28, 30 and out through the side seams 46, 48. The strap 72 has the central portion thereof anchored at the back of the seat to the inner surface of the cover 36 by stitching 74 as is best shown in FIGS. 5 and 6. The strap 72 has short projecting ends 76 which carry buckles 78 for releasably and adjustably receiving the free ends 70 of the strap 66.

In order to facilitate carrying of the chair in a manner to be described hereinafter, the remote edges of the compartments 28, 30, centrally of the height thereof, are provided with straps defining carrying handles 80. Each carrying handle 80 has the end portions thereof passing into the interior of the respective one of the compartments 28, 30 through a respective one of the side seams 46, 48 with the ends of the carrying handles 80 being suitably sewn to the cover 36 preferably within the side seams 46, 48.

The compartments 28, 30 also carrying retaining straps 82, 84 which are sewn to the cover 36 and extend out through respective ones of the side seams 46, 48 centrally of the carrying handles 80. The straps 82, 84 carry a suitable type of releasable binding means, such as Velcro fastening means 86.

At this time, particular attention is directed to the fact that the effective width of the longitudinal hinge portion 26 is relatively narrow as compared to the effective width of the longitudinal hinge portion 32. Thus, when it is desired to store or carry the seat 10, the compartments 22, 24 are folded into overlying relation with respect to the compartments 28, 30, respectively, along the transverse hinge portion 16. Then the compartments 22, 28 on the one hand and the compartments 24, 30 on the other hand are folded relative to one another along the longitudinal hinge portions 26, 28 with the compartments 22, 24 having the rear faces thereof disposed in face-to-face relation while the compartments 28, 30, due to the greater width of the longitudinal seam portion 32 being folded against the compartments 22, 24, respectively in face-to-face relation. This is best shown in FIG. 7.

Figure 7:
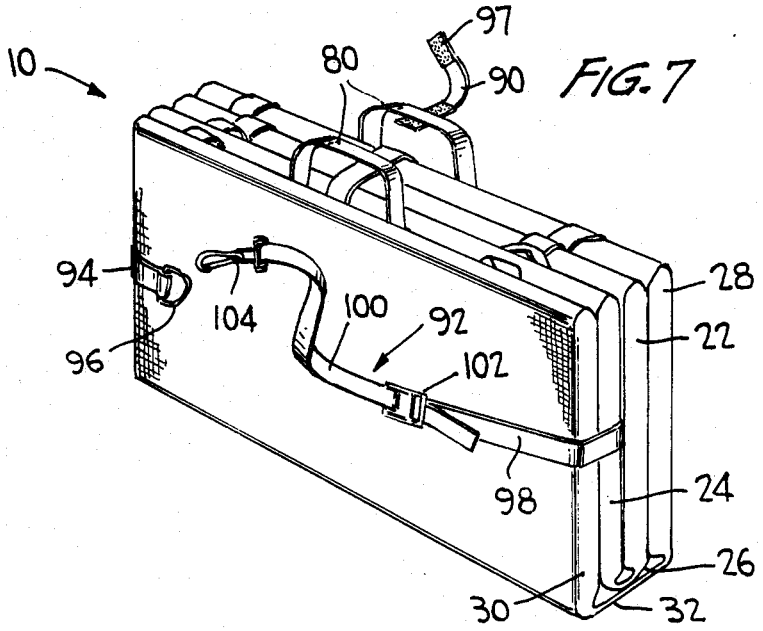
FIG. 7 is a view in perspective of the beach chair of FIG. 1 folded into its collapsed configuration.

When the compartments 22, 24, 28 and 30 are folded in the manner illustrated in FIG. 7, the ends of the straps 82, 84 may then be engaged so as to hold the compartments in their folded positions. At this time the chair 10 may be readily carried utilizing the carrying handles 80.

If desired, the carrying handles 80 may also be bound together by way of a further strap 90 which may be suitably secured to one of the carrying handles 80. The strap 90 is preferably provided with suitable releasable fastening means such as Velcro 91. The strap 90 will be engaged around the gripping portions of the carrying handles 80 and the ends thereof secured together Finally, if it is desired to carry the chair 10 generally over one's back, the chair 10 may be provided with a shoulder strap assembly, generally identified by the numeral 92. In the preferred embodiment, the shoulder strap means 92 is carried by one of the compartments 22, 24 and extends generally around an adjacent one of the compartments 28, 30. However, more broadly speaking, the shoulder carrying strap means 92 needs to be anchored at opposite ends of the chair 10 in its folded state.

Most specifically, the shoulder carrying strap means 92 includes a first strap 94 anchored at one end of the folded chair 10 and carrying at the opposite end a ring 96. A second strap 98 is anchored at the opposite end of the folded chair 10 and is provided with an adjustable extension 100. The strap 98 and the extension 100 are adjustably connected together by means of a buckle 102. The strap extension 100 is provided at its free end with a suitable snap type hook 104 for engagement with the ring 96.

Inasmuch as the present invention is subject to many variations, modifications and changes in detail, it is intended that all subject matter discussed above or shown in the accompanying drawings be interpreted as illustrative and not in a limiting strength.

What I claim is:

1. A collapsible beach chair comprising:

a flexible covering defining a front side and a rear side of said chair, said covering having portions joined together to define four compartments including first and second generally rectangular seat compartments and first and second generally rectangular back compartments separated by integral hinge-defining portions of said covering, wherein said first and second seat compartments are in substantial longitudinal alignment with said first and second back compartments, respectively, said hinge-defining portions comprising means for facilitating folding of said chair to a compact collapsed stack of said four compartments in side-by-side relation;

four compartment stiffening members disposed in said four compartments, respectively, each stiffening member comprising a rigid rectangular member having at least one padded surface facing the front side of said chair;

wherein said hinge-defining portions include a transverse hinge portion extending between seat compartment and said back compartments, a longitudinal back hinge portion extending between said first and second back compartments, and a longitudinal seat hinge portion extending between said first and second seat compartments;

an integral back support strap extending transversely through said first and second back compartments and having first and second free ends extending out from first and second mutually remote longitudinal edges of said first and second back compartments, respectively, wherein said back support strap is bonded to said covering inside each of said first and second back compartments at locations between the stiffening members and the rear side of the chair;

an integral seat support strap extending transversely through said first and second seat compartments and having first and second free ends extending out from first and second mutually remote longitudinal edges of said first and second seat compartments, respectively, wherein said seat support strap is bonded to said covering inside each of said first and second seat compartments at locations between the stiffening members and the rear side of the chair;

first engagement means for releasably securing the first ends of said back support strap and said seat support strap directly together to provide an adjustable length engagement between the first longitudinal edge of said first back compartment and the first longitudinal edge of said first seat compartment; and second engagement means for releasably securing the second ends of said back support strap and said seat support strap directly together to provide an adjustable length engagement between said second longitudinal edge of said second back compartment and said second longitudinal edge of said second seat compartment.

2. The collapsible beach chair according to claim 1 wherein said flexible covering is canvas and sewn together at seams to define said compartments, and wherein said back support strap and said seat support strap are bonded to said covering by stitched seams extending along the respective lengths of the straps.

3. A chair according to claim 1 wherein said longitudinal back hinge portion is relatively narrow to permit said first and second back compartments to be folded in side-by-side facing relation, and wherein said longitudinal seat hinge portion is relatively wide to permit said first and second compartments to be folded in spaced apart side-by-side facing relation to one another with said first and second back compartments positioned therebetween.

4. The chair according to claim 1 further comprising cooperating strap means extending from said first and second mutually remote longitudinal edges of said seat compartments for releasably holding the four compartments in said folded relation.

5. The chair according to claim 1 further comprising first and second handles secured to said first and second mutually remote longitudinal edges of said seat compartments, and positioned adjacent one another in the folded relation of said compartments.

6. The chair according to claim 1 further comprising shoulder carrying strap means secured to the chair for permitting the chair in said folded relation to be supported on one's shoulder.

7. The chair according to claim 1 wherein each of said compartments has an open edge for facilitating the insertion of each stiffening member into a respective one of said compartments.

8. The chair according to claim 7 wherein said transverse hinge portion is in part defined by a separate flexible strip, and wherein said open edges are formed between ends of said covering and ends of said strip.

* * * * *